US007000713B2

(12) United States Patent
Crooks

(10) Patent No.: US 7,000,713 B2
(45) Date of Patent: Feb. 21, 2006

(54) BLOCKLESS REAMER

(75) Inventor: Jay Camron Adam Crooks, Calgary (CA)

(73) Assignee: NQL Energy Services, Ltd., Nisku (CA)

( * ) Notice: Subject to any disclaimer, the term of this patent is extended or adjusted under 35 U.S.C. 154(b) by 166 days.

(21) Appl. No.: 10/604,877

(22) Filed: Aug. 22, 2003

(65) Prior Publication Data

US 2005/0039953 A1 Feb. 24, 2005

(51) Int. Cl.
*E21B 10/30* (2006.01)

(52) U.S. Cl. ..... 175/406; 175/325.3; 175/346

(58) Field of Classification Search ..... 175/325.3, 175/325.4, 325.6, 325.7, 344–350, 406

See application file for complete search history.

(56) References Cited

U.S. PATENT DOCUMENTS 2,872,159 A * 2/1959 Autry ..... 175/346
3,680,646 A * 8/1972 Hughes et al. ..... 175/323
4,508,184 A * 4/1985 Hansen ..... 175/346
5,381,868 A 1/1995 Schock

* cited by examiner

*Primary Examiner*—Zakiya W. Bates
(74) *Attorney, Agent, or Firm*—Merek, Blackmon & Voorhees, LLC

(57) ABSTRACT

A blockless reamer drilling tool comprising an elongated tool body and a reamer unit. The reamer unit includes, a shaft having a first end and a second end and a cutter mounted on the shaft between the first and second ends. A pocket on the exterior surface of the tool body is sized to accept the reamer unit with a portion of the reamer unit recessed in the pocket. A plurality of pins engage the tool body and secure the reamer unit within the pocket. The plurality of pins includes a first pin engaging the tool body and passing through the shaft at the first end and a second pin engaging the tool body and passing through the shaft at the second end.

10 Claims, 6 Drawing Sheets

BLOCKLESS REAMER

BACKGROUND OF INVENTION

This invention relates to reamers and similar tools for enlarging bore holes and, in particular, to blockless reamers.

Reamers for enlarging bore holes drilled for oil wells and mine shafts have been known in the drilling art for many decades. Typically, a reamer includes a central body having three or more roller reamer units mounted at circumferally spaced intervals around the tool body. The reamer tool is mounted in a string of drill pipe, drill collar or other rotatable pipe such that the reamer is rotated with the drill pipe through the well bore in order to enlarge the bore. The roller reamer units rollably engage the well bore wall to enlarge the bore as the drill string moves through the hole. Roller reamers are used to roll against the hole wall of an in-gauge hole to reduce the torque of the drill collars against the hole wall of a directionally drilled hole.

Roller reamer tools have traditionally included means for installing a reamer unit whereby the reamer unit was sealed into the reamer tool. Blocks have been utilized to fixedly hold a reamer unit in position whereby the shaft of a reamer unit extends into upper and lower bearing blocks so as to be fixedly mounted within a pocket cut into a reamer tool. The blocks are machined to cooperate with the pocket to hold the reamer unit in place within a pocket. The reamer tool pocket must also be machined to specifically allow the block piece to be fixedly fitted therein. Blocks of a variety of shapes and sizes have been applied in the prior art.

Blocks mounted in pockets cut into the reamer tool can be cumbersome to insert and remove causing the reamer unit to be difficult to remove from the reamer tool. The inclusion of blocks into the design of the reamer tool requires that individual blocks and a specific tool pocket shaped to receive an individual block must be machined specifically to fit together.

SUMMARY OF INVENTION

The present invention relates to a blockless reamer tool comprising: an elongated tool body including an exterior surface; a reamer unit; a pocket on the exterior surface of the tool body sized to accept the reamer unit therein with a portion of the reamer unit recessed in the pocket; and a plurality of pins engaging the tool body and securing the reamer unit within the pocket.

The use of pins rather than blocks to secure the reamer unit within the pocket causes the reamer tool to be easier to machine due to the fact that no individual pieces besides the tool body are required to be fashioned; and the shape of the pocket is simpler, as it does not need to include features necessary for the insertion of a block. The application of pins further causes the reamer tool to be easier to assemble and take apart. The pin configuration means it is relatively simple to remove reamer units from the body. Thus, worn cutters can be replaced, or pristine reamer units can be removed and refitted into another tool body. Generally the pin is engaged at each end in the tool body and extends across the pocket. In one embodiment, the pins are each engaged to the tool body by insertion into holes drilled through the body, the holes opening into the pocket such that the pins each extend across the pocket. The holes can be formed with a countersink portion to facilitate installation of the pins.

The pins generally are positioned to secure the reamer unit at its ends. However, other pin configurations can be used such as a configuration positioning the pins to engage the reamer unit at one or more positions between the reamer unit ends.

The reamer unit generally includes a shaft with a cutter mounted thereon, in a manner so that the cutter is rotatable about the shaft. Holes can be drilled through either end of the shaft to receive therethrough the pins for securing the reamer unit in the pocket. In such an embodiment, the shaft must be sized to accommodate the holes without being compromised to the extent that unacceptable failure of the shaft occurs due to the holes.

The reamer unit can be positioned on the tool body in a positioned aligned with the long axis of the tool, in which position the reamer unit is termed "straight", or offset from the tool long axis, in which position the reamer unit is termed "slant".

The blockless reamer tool can be built to a variety of sizes, as will be appreciated, for example, depending on the size of the bore hole in which the tool is to be employed. The tool can include one or more reamer units. Where more than one reamer unit is mounted on the tool body, the reamer units and, therefore, the pockets formed to accommodate them, can be spaced circumferentially and/or vertically in relation to each other. The numbers of reamer units included can be selected with consideration as to the size of the tool body, the size of the reamer units and the operational expectations of the reamer tool.

These and other features of the blockless reamer tool according to the present invention will become more apparent with reference to the following detailed description.

DETAILED DESCRIPTION

Figure 1:
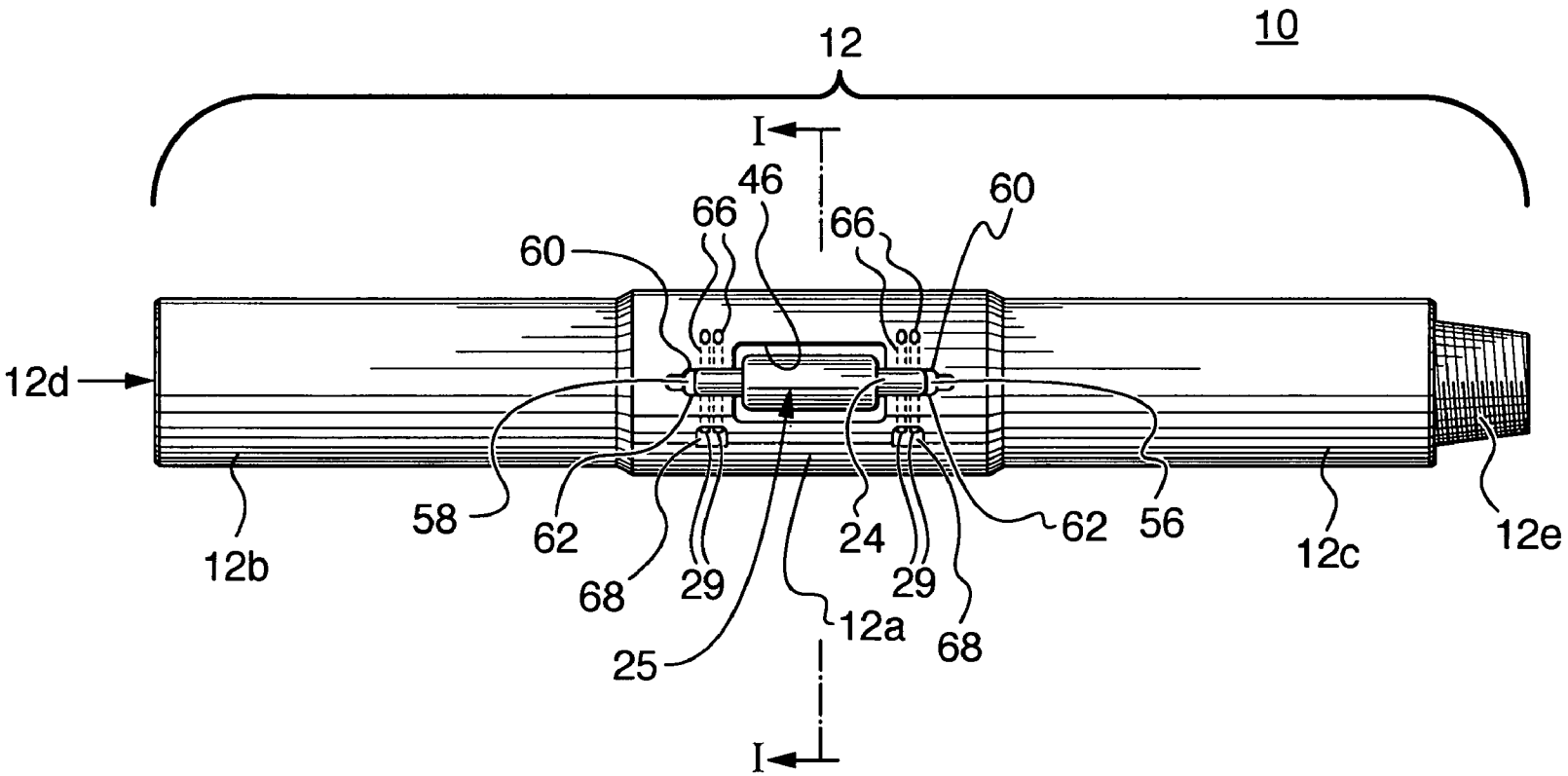
FIG. 1 is a side view of a blockless reamer tool having a straight reamer unit.
Figure 2:
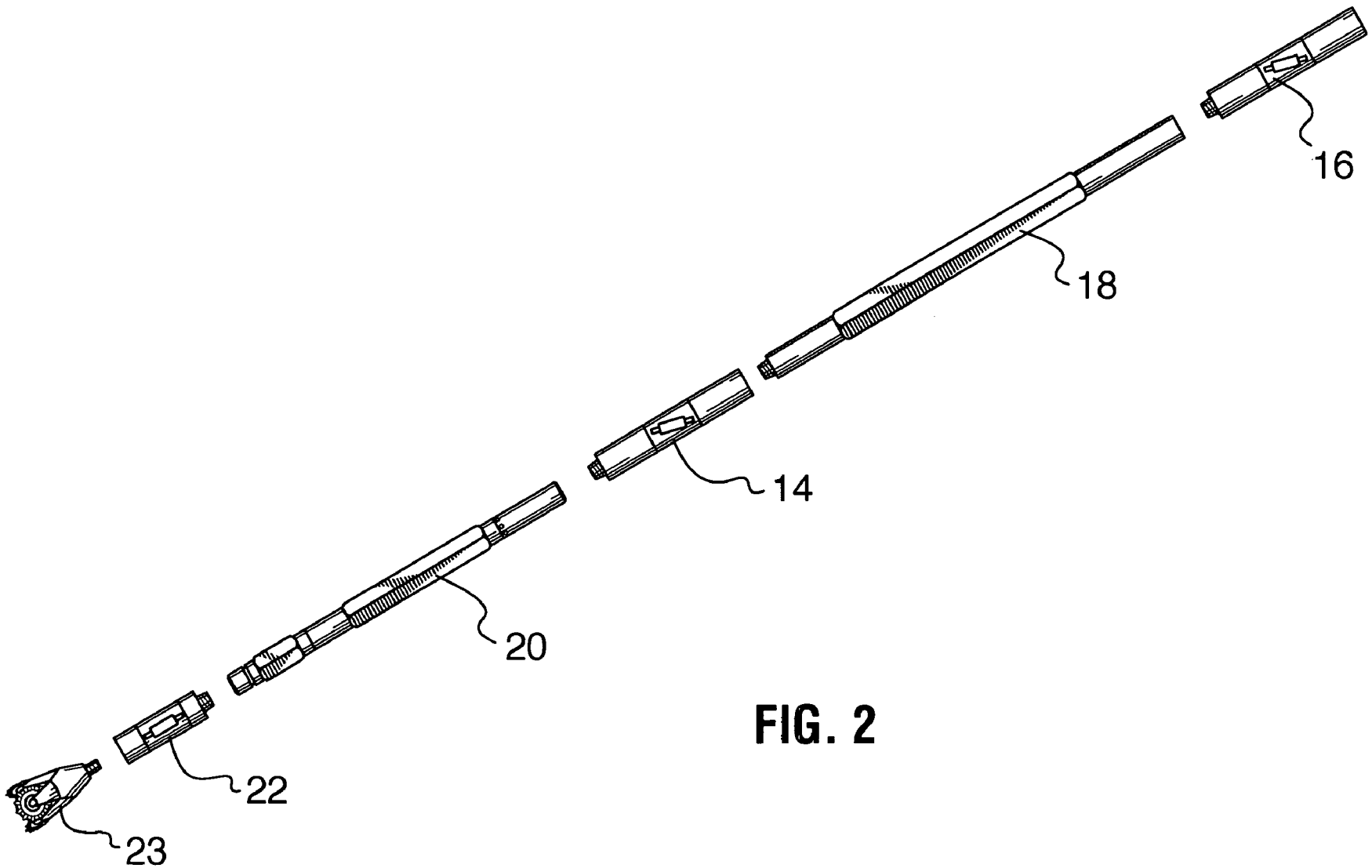
FIG. 2 is a side view of a drill string in exploded configuration incorporating blockless reamer tools according to the present invention.

As shown in FIG. 1, the blockless reamer drilling tool 10 includes a generally cylindrical, elongated body 12 which includes a constant diameter cylindrical section 12*a* and a reduced diameter upper section 12*b* and a reduced diameter lower section 12*c*. The reduced diameter upper section 12*b* terminates a "box" end portion having a female thread section 12*d* commonly used in oil well drilling tool designs. The lower reduced diameter section 12*c* terminates in a "pin" end having external threads 12*e* to mount the reamer tool in an oil well drill string or other string of pipe for insertion into a bore hole in an oil well or any other bore hole such as a mining bore hole, as shown in FIG. 2. In appli cation, the reamer tool acts to stabilize a bore hole and ensure that the bore hole is drilled to gauge.

FIG. 2 shows the integration of multiple blockless reamer drilling tools within a portion of a drill string. In one embodiment of the invention a drill string may be created so that two blockless slant reamer tools 14 and 16 are included in the string with a drill collar 18 between them. A mud motor 20 may separate a blockless slant reamer tool 14 from a blockless straight reamer tool 22 which attaches to the drill bit 23. As is common knowledge in the art of drill string selection, the elements of a drill string can be selected and ordered in a variety of ways depending on the bore hole that is to be drilled.

Figure 5:
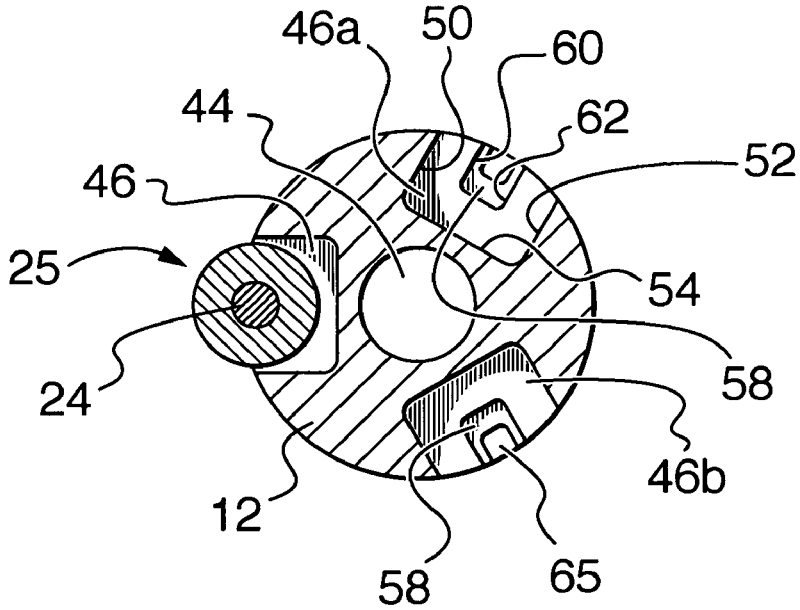
FIG. 5 is a sectional view along lines I—I of FIG. 1.

As shown in FIG. 5, the tool body 12 has an internal, constant diameter bore 44 through which fluids such as drilling fluid may flow during oil well drilling operations, as is well known in the art. The body may be formed of a variety of materials depending on the bore hole to be drilled. One embodiment of the invention may be formed from steel, for example stainless steel, 41/45 or 41/40 grade steels, although other durable materials may be utilized.

The central body section 12*a* includes at least one pocket 46, into which a reamer unit 25 is mounted. FIG. 5 shows one embodiment of the invention having three pockets 46, 46*a*, 46*b* circumferentially positioned in the central body 12. While only one is shown, each of the pockets receives therein a reamer unit 25. Body 12 with pocket 46 can be formed, for example, by milling, machining, casting, etc.

Figure 3:
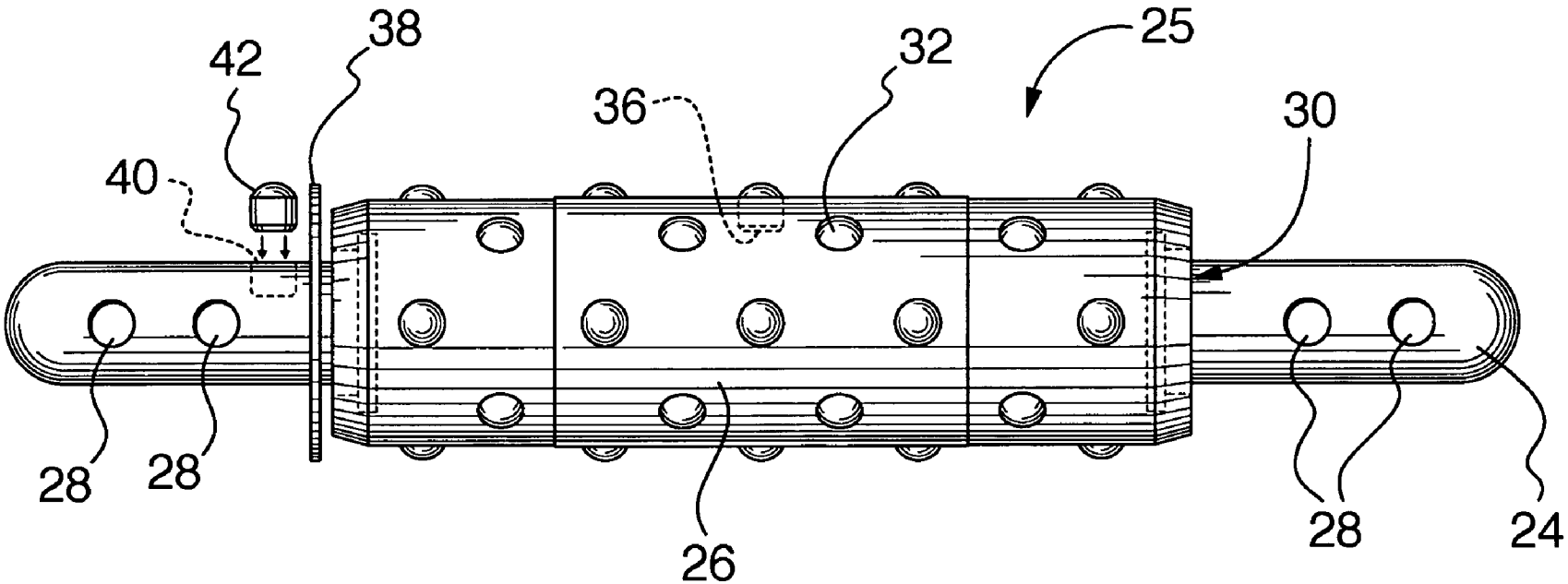
FIG. 3 is a top plan view of a reamer unit useful in the present invention.

A reamer unit 25, as shown in FIG. 3, includes a shaft 24 and a generally cylindrical cutter 26. The shaft 24 has ends formed for securing to the tool body 12 and is formed therebetween to support the cutter 26. Holes 28 are cut into each of the shaft ends to accept pins 29 for securing the shaft 24 to the body 12 of the reamer tool. In the illustrated embodiment, there are two holes 28 at each end of the shaft, since it is desired to mount the shaft using two pins at each end. This permits redundancy and provides sufficient strength to overcome the rigors of use downhole to avoid premature failure. Holes 28 can be offset, etc. as desired. Shaft can include flat faces 31 on its ends to enhance engagement of the shaft to the tool body, by formed the tool body to have a mounting pocket/reamer unit shaft shaped to conform. The flats operate to prevent rotation of the shaft during use and enhances transmission of stresses from the shaft to the tool body.

The hollow cutter 26 includes an internal bore 30 and, for use, is mounted on the shaft 24 in a way that permits hollow cutter 26 to rotate relative to the shaft. The shaft and cutter 26 are formed such that the cutter can rotate about the shaft. The cutter 26 includes a plurality of cutters, for example tungsten carbide buttons 32, fixedly fit within depressions, one of which is shown in phantom as item 36 in FIG. 3, in the cutter to enhance the wear characteristics of the outer surface of the cutter. In the illustrated embodiment, a stress washer 38 is mounted onto the shaft 24 in a position adjacent to the cutter 26. The washer can be mounted at either end of the cutter to protect the cutter. A depression 40 can be included in the shaft into which a button 42 may be inserted. The depression 40 is be formed to be of a depth that would allow a portion of the button 42 to protrude above the surface of the shaft, the protruding portion of the button 42 creating an effective diameter greater than the hole cut in the center of the washer, when the washer is mounted upon the shaft, or the bore of the cutter to hold the cutter and washer in position along the shaft.

Figure 4A:
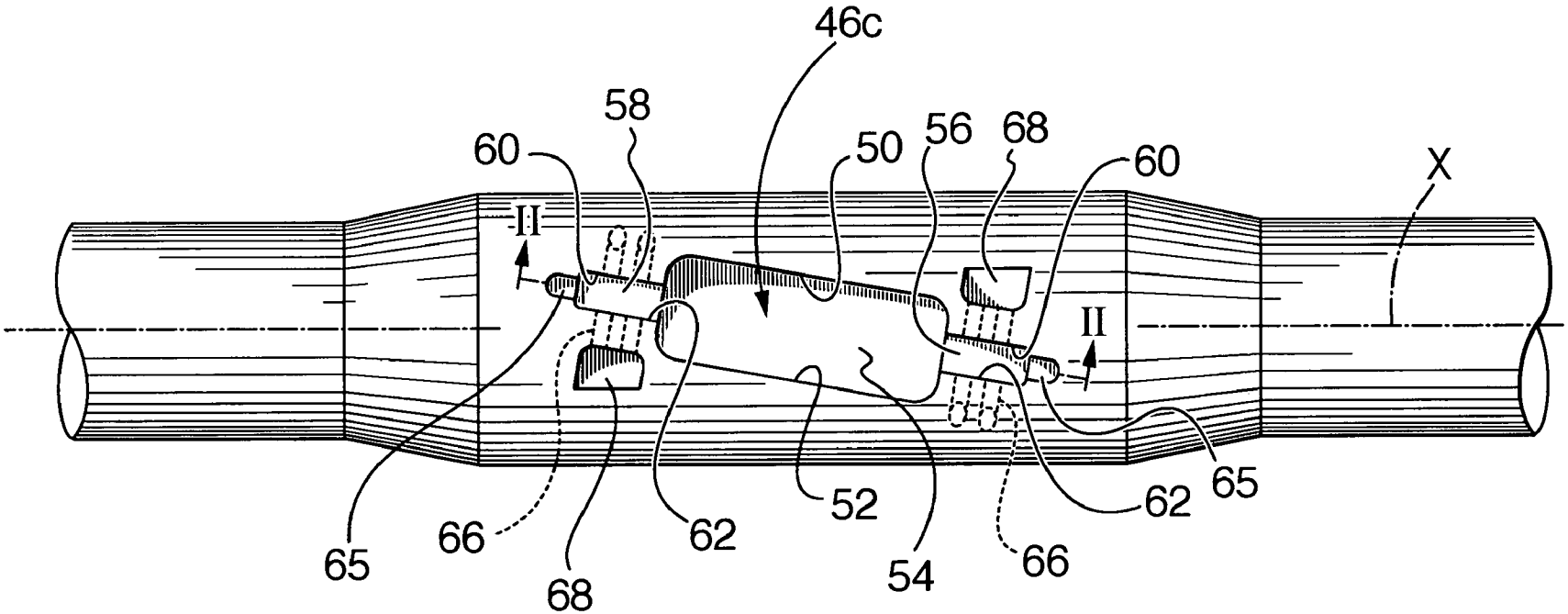
FIG. 4*a* is a side elevation of a blockless reamer tool with its reamer unit removed.
Figure 4B:
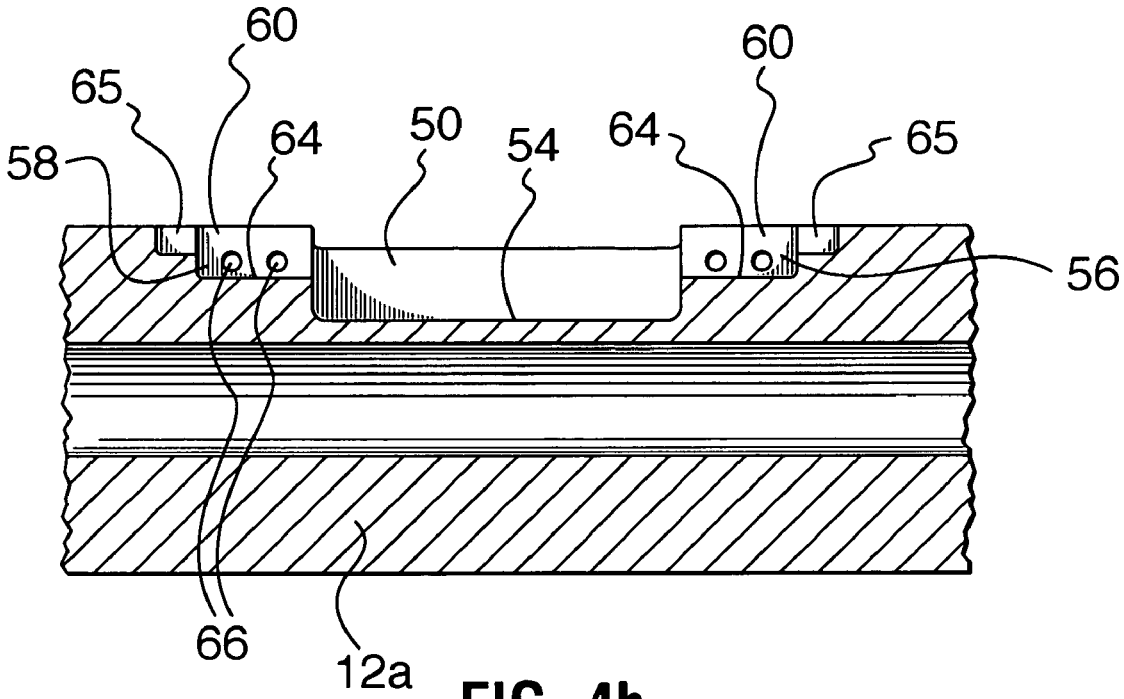
FIG. 4*b* is a sectional view through the pocket of FIG. 4*a*, along lines II—II.
Figure 6:
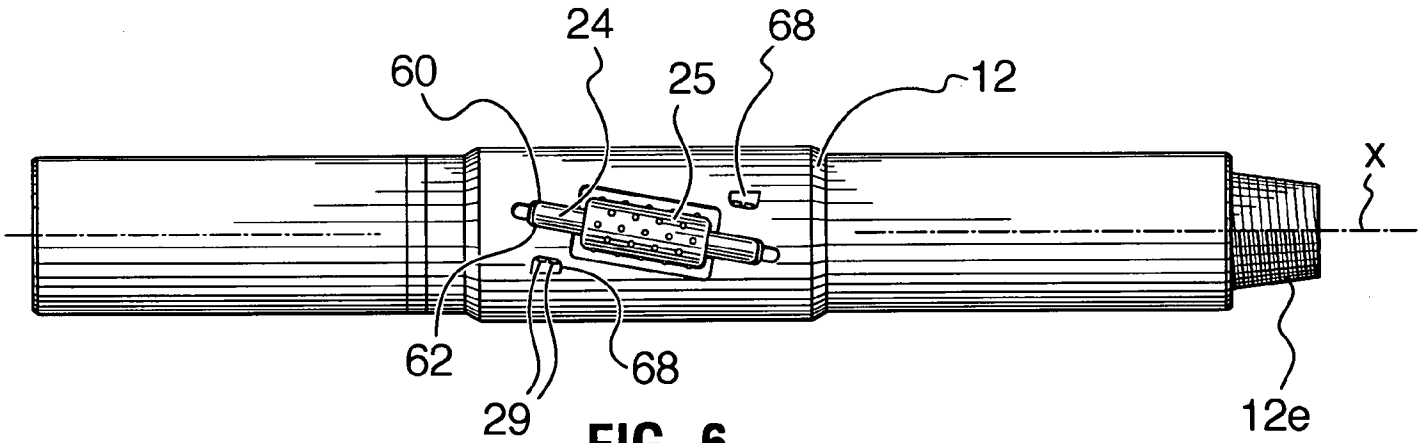
FIG. 6 is a side view of the blockless reamer tool showing a slant reamer unit inserted in a pocket.

Alternately or in addition to axially-directed reamers, the reamer tool can, as shown in FIGS. 4 and 6, include slanted reamers by forming pockets 46*c* on an angle from the long axis x of the tool. The long axis of the pockets can be formed to position the shaft of the reamers from 0 to 20° from the long axis.

The pockets 46 to 46*c* each include a central reamer recess defined by side faces 50 and 52 and a bottom surface 54. The width of the reamer recess between side faces 50 and 52, is greater than the outer diameter of the cutter of the reamer unit to be mounted therein. The pockets each further include an end extensions 56, 58 formed to support the shaft of the reamer units at its end. Extensions 56, 58 have side faces 60 and 62 and a bottom face 64. The extensions are sized to support the shaft 24 of the reamer unit therein such that cutter is spaced from surfaces 50, 52 and 54 of the pocket central recess. As noted herein above, the extensions can be formed to conform to the shape of the shaft at its ends to enhance engagement therebetween.

In the illustrated embodiment, the pockets further include notch portions 65 to facilitate handling of the reamer units during installation to and removal from the pockets.

As shown in FIG. 1, at least one pin hole 66 must be drilled into the body 12 across the pocket in the extensions 56, 58 to accept the pins 29 for securing the shaft of the reamer units. Each hole 66 will be drilled across the pocket 46 through walls 60 and 62. At least one end of the hole 66 will be accessible from the exterior of the body 12 such that pins 29 can be driven therein. A countersink 68 may be formed in the body 12 at the position of the hole 66 that is accessible from the exterior of the body 12. The countersink 68 may be formed to include a flat edge at the exposed end of the hole 66.

To assemble a reamer tool, a reamer unit 25 is assembled by mounting cutter 26 on shaft 24. The reamer unit is then placed into its pocket with the shaft ends supported on extensions 56, 58 and holes 28 aligned with holes 66. Pins 29 are then inserted into each hole 66 to secure the reamer unit within the pocket with the cutter in the central recess. In particular, each pin is forced into a hole 66 starting at its exposed end, for example, at counter sink 68. As will be appreciated, the pin will continue to be forced through hole 66, through hole 28 in the shaft and then finally back into the opposite end of the hole. The opening of countersink 68 provides a surface from which the pin 29 may be pounded into the hole 66 to ensure a snug fit. A spring pin may be utilized, as could a variety of types of pins with consideration as to the stresses which will be encountered downhole.

If desired, the pin can be removed, as by drilling, punching, etc., from the hole to allow the reamer unit to be taken out of the reamer recess. In this manner a worn or damaged reamer unit can be removed from a tool and replaced. A reamer unit may also be removed from a blockless reamer tool in this manner so that it can be placed in another reamer tool. This occurs if the blockless reamer tool should break or become worn while the reamer unit remains in good working condition.

Figure 7:
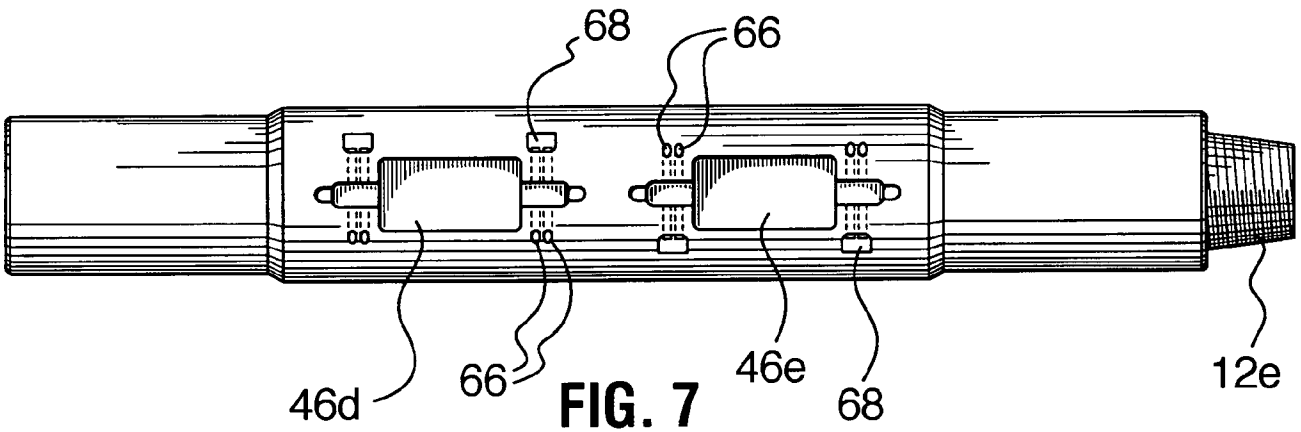
FIG. 7 is a side view of a blockless reamer tool with multiple pockets vertically positioned, the reamer units having been removed therefrom.

As shown in FIGS. 1 and 6, the invention may incorporate both straight reamer units, as shown in FIG. 1, or slant reamer units, as shown in FIG. 6. A reamer tool according to the present invention, can also include axially spaced apart reamer units by so forming pockets. For example, a reamer tool body 12 is shown in FIG. 7 including pockets 46*d*, 46*e* axially spaced thereon. In use, reamer units can be placed in the pockets.

While presently preferred embodiments of the invention have been described herein for the purpose of disclosure, numerous changes in construction and arrangement of parts may be evident to those skilled in the art and those changes are encompassed within the spirit of this invention as defined by the appended claims.

The invention claimed is:

1. A reamer drilling tool comprising:

an elongated tool body including an exterior surface;

a reamer unit including a shaft having a first end and a second end and a cutter mounted on the shaft between said first and second ends;

a pocket on the exterior surface of the tool body sized to accept the reamer unit therein with a portion of the reamer unit recessed in the pocket;

and a plurality of pins engaging the tool body and securing the reamer unit within the pocket, the plurality of pins including a first pin engaging the tool body and passing through said shaft at said first end and a second pin engaging the tool body and passing through said shaft at said second end; and, wherein said reamer drilling tool is blockless.

2. A reamer drilling tool according to claim 1 wherein the body has a fluid circulation bore therethrough.

3. A reamer drilling tool according to claim 1 wherein the end sections of the body are threaded whereby the body may be adjoined with tubular members of a drill string.

4. A reamer drilling tool according to claim 1 wherein the cutter is a substantially cylindrical roller mounted over said shaft, the roller being rotatable about the shaft.

5. A reamer drilling tool according to claim 4 wherein the shaft includes flattened side surfaces selected to correspond to the shape of the pocket.

6. A reamer drilling tool according to claim 1 wherein the pins are spring pins.

7. A reamer drilling tool according to claim 1 wherein the pocket is formed to provide for mounting the reamer unit with said shaft extending in an axial direction with respect to the body.

8. A reamer drilling tool according to claim 1 wherein the pocket is formed to provide for mounting the reamer unit with said shaft extending in a slanted direction with respect to the longitudinal axis of said tool body.

9. A reamer drilling tool according to claim 1 including a plurality of pockets spaced circumferentially about the body, each with a reamer unit mounted therein.

10. A reamer drilling tool according to claim 1 including a plurality of pockets spaced axially along the body, each with a reamer unit mounted therein.

* * * * *